United States Patent [19]

Madfis

[11] 4,068,424

[45] Jan. 17, 1978

[54] RAINWATER RUN-OFF DISPERSION SYSTEM

[76] Inventor: Alfred W. Madfis, 38 Pine St., Swampscott, Mass. 01907

[21] Appl. No.: 747,896

[22] Filed: Dec. 6, 1976

[51] Int. Cl.[2] ..... E04D 13/00

[52] U.S. Cl. ..... 52/94; 52/97

[58] Field of Search ..... 52/57, 58, 395, 90, 52/94, 97, 96, 95, 11, 12, 73

[56] References Cited

U.S. PATENT DOCUMENTS

| | | | |
|---|---|---|---|
| 1,971,932 | 8/1934 | Guiterman | 52/24 |
| 2,109,447 | 2/1938 | Sadtler | 52/15 |
| 3,188,772 | 6/1965 | Tennison | 52/97 |
| 3,939,616 | 2/1976 | Schapker | 52/97 |

*Primary Examiner*—John E. Murtagh

*Attorney, Agent, or Firm*—Alan J. Kaplan

[57] ABSTRACT

A rainwater run-off dispersion system comprising mounting means and receiving surface with a plurality of fixed baffles, spaced tangentially at the roof edge of a building in the path of rainwater falling therefrom and preferably inclined outwardly and downward away from said building, said baffles uniformly distributing and dispersing rainwater away from same building and breaking up same into a relatively fine and dispersed shower of droplets.

5 Claims, 8 Drawing Figures

RAINWATER RUN-OFF DISPERSION SYSTEM

BACKGROUND OF INVENTION

1. Field of Invention

The present invention relates to the controlled dispersal of rainwater run-off from buildings with sloped or pitched roofs. The invention provides means for the dispersal of the substantially planar rainwater run-off from roof edges, thereby eliminating the need for gutters.

2. Description of Prior Art

At present, rainwater run-off from most buildings is normally controlled by the installation of gutters, eaves trough or by letting the rainwater fall unrestricted to ground level. Free-flowing gutters normally act as a means for channelling rainwater run-off to a downspout from which it discharges to ground level. In most instances, this is satisfactory, but nevertheless, maintenance of free-flowing gutters can be expensive and time-consuming because of ice formations, the accumulation of leaves, and deterioration due to exposure nature which necessitates replacement. Many buildings consequently are without gutters or their replacement when required is merely omitted. Rainwater run-off from roofs without gutters falls unimpeded, at high velocities which are accelerated by gravity. Consequently, small trenches or gullies are created or formed in the ground by the impact of these high velocities. The resulting splashes transfer soil particles to the vertical surfaces of buildings which are both unsightly and requires constant cleaning. Damage to bushes, gardens, and landscapes may result from erosive effect of rainwater run-off. The aforementioned conditions can be partially curtailed by the installation of various drainage or capturing means at ground level. Cement troughs are the most common type but these are very costly to both purchase and install and are not always practical because of shrubbery arrangements or owing to the contour of the land.

SUMMARY OF INVENTION

Principal objects of this invention are to provide a means for dispersing or disposing of rainwater run-off from pitched or sloped roofs without the use of conventional gutters or eaves troughs whose many deleterious effects accompany the unrestricted flow of rainwater run-off. Another objective of this invention is to provide a rainwater run-off dispersion system which is not susceptible to blockage due to accumulation of leaves or other foreign matter. A still further objective of this invention is to provide an inexpensive rainwater run-off dispersion system which is less costly to install than gutters and will solve the run-off problem while adaptable to many different types of dwellings and roof designs. According to the invention, a series of baffles impede and uniformly distribute the flow of rainwater run-off so that it is dispersed in a random pattern of small droplets as it falls to ground level. This invention features a means for mounting a disperser in a position horizontally aligned at the roof edge and a substantial distance above the ground in the path of rainwater flowing therefrom. The disperser connected to the mounting means comprises an elongated structure with raised baffles on an intercepting surface for positioning at the roof edge and is of sufficient width to intercept and disperse the heaviest flow of rainwater. The disperser contains a plurality of raised baffles to restrict, channel, separate and disperse rainwater run-off into a shower of droplets over an extended area at the ground. In its preferred embodiments such means comprises a plurality of contoured baffles spaced across the width of the intercepting surface and connected to a mounting means which maintains it at fixed incline downward and outward from a building thereby to disperse rainwater run-off downwardly away from said building to which the disperser has been affixed. In the preferred embodiments, mounting means are generally non-detachable from the disperser and with said mounting means affixed vertically the disperser is inclined downward and slightly away from the building.

BRIEF DESCRIPTION OF THE DRAWINGS

Other features, advantages and objects of this invention will be apparent to those skilled in the art from the following detailed description of preferred embodiments thereof taken together with the accompanying drawings, in which.

DESCRIPTION OF THE PREFERRED EMBODIMENTS

Figure 1:
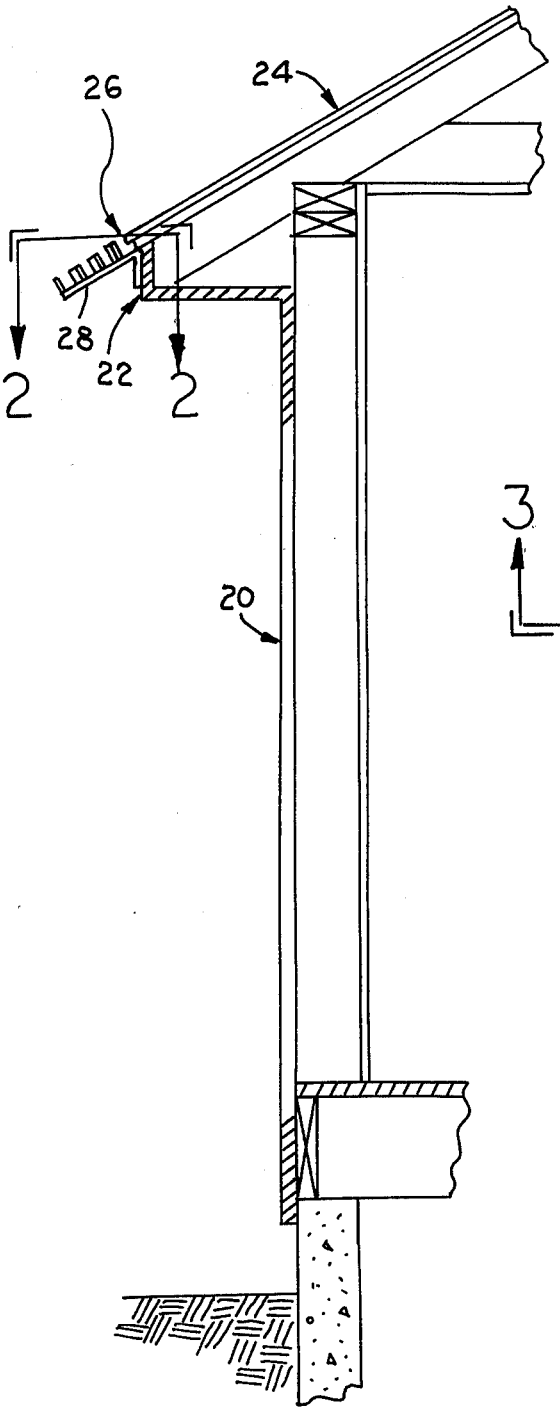
FIG. 1 is a sectional view of the dispersion structure mounted on a building at a roof edge thereof.
Figure 2:
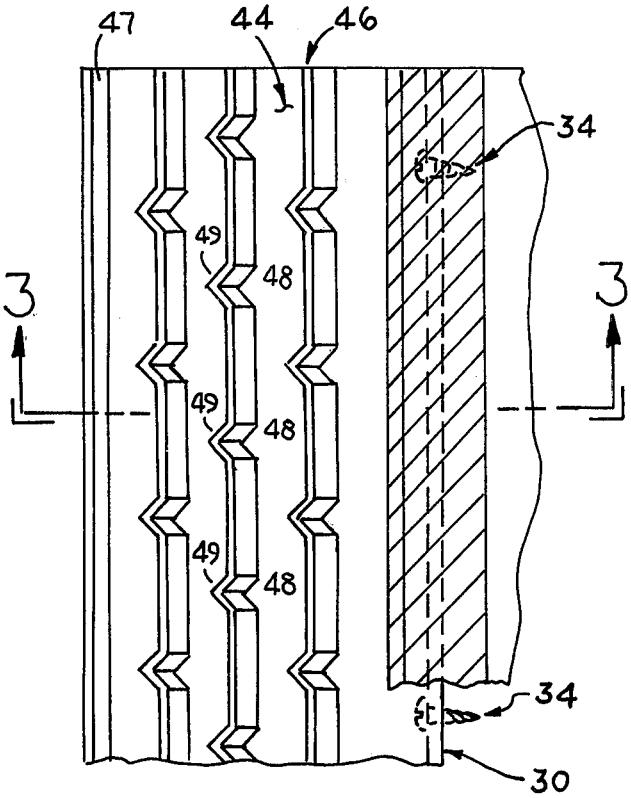
FIG. 2 is an enlarged fragmentary plan view of a dispersion structure taken along the line 2—2 of FIG. 1.
Figure 3:
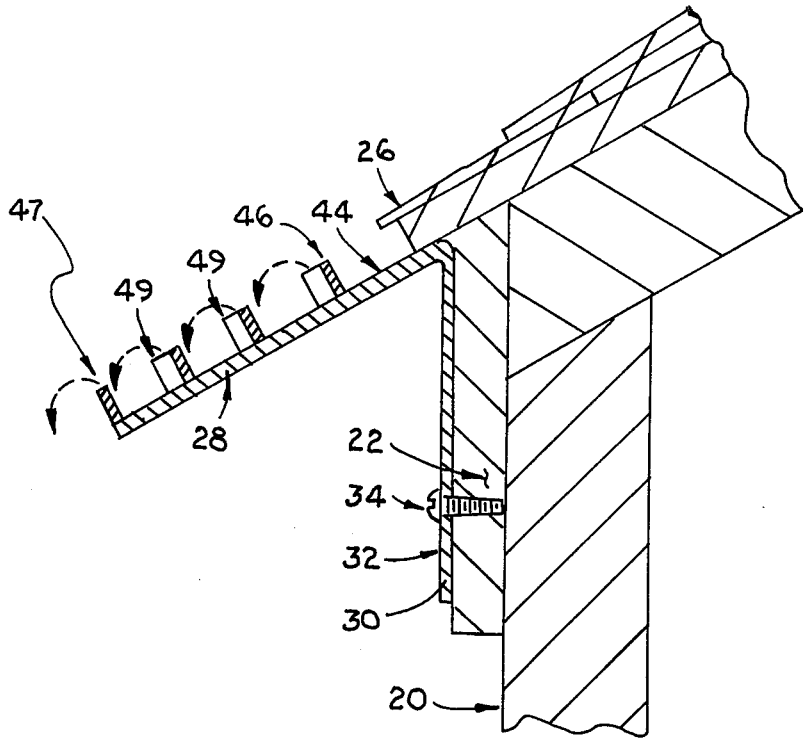
FIG. 3 is an enlarged view similar to that of FIG. 1, of the mounted dispeerser, in a section along the line 3—3 of FIG. 2.
Figure 4:
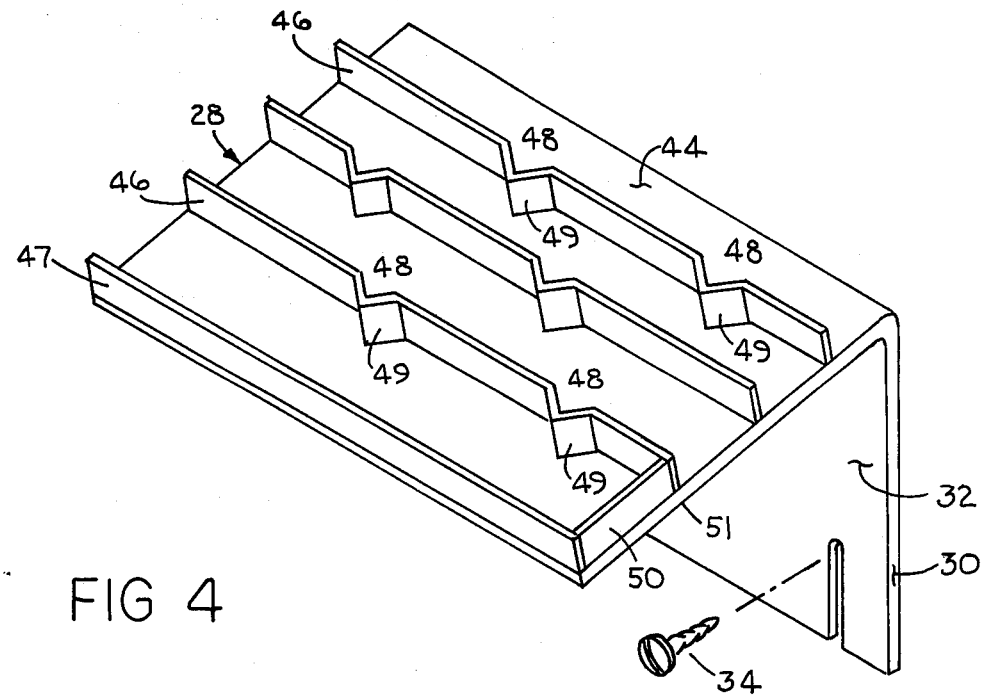
FIG. 4 is a fragmentary, isometric, exploded end view of the dispersion structure and its mounting areas.
Figure 5:
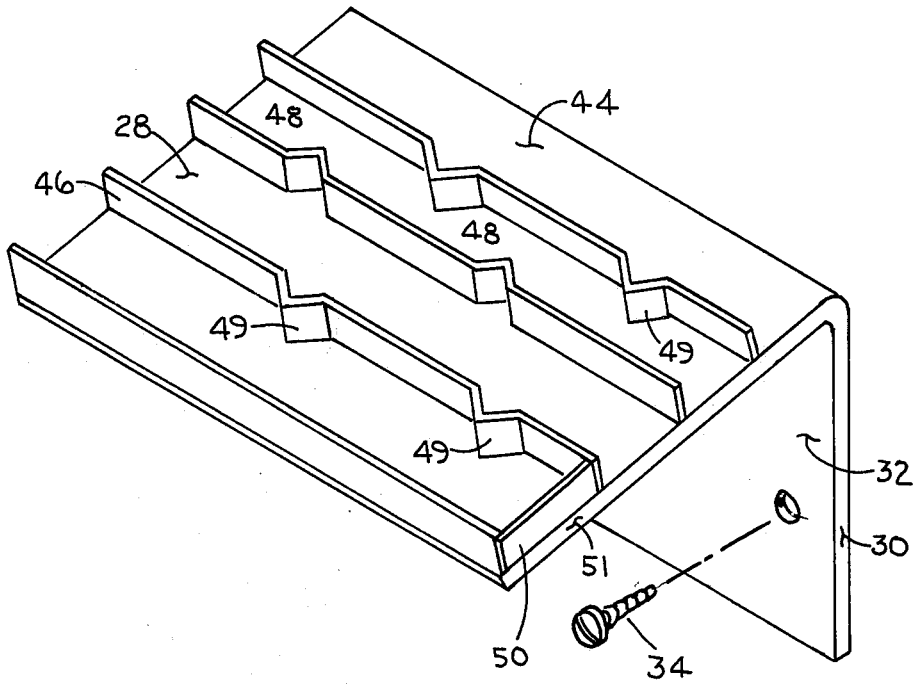
FIG. 5 is a fragmentary, isometric, exploded end view of an alternate embodiment of the dispersion structure.
Figure 6:
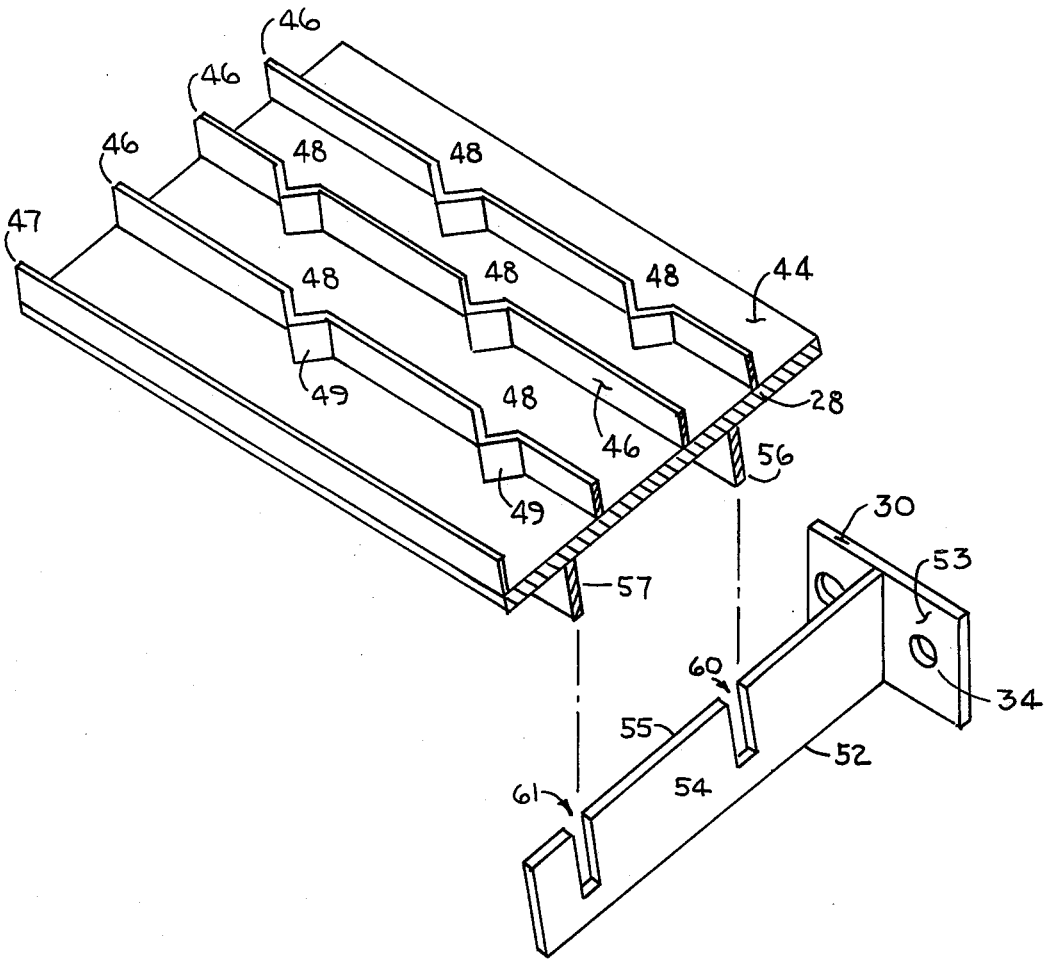
FIG. 6 is a fragmentary, isometric, exploded view of alternate embodiments of the disperser and alternate bracket for mounting means thereof.

Referring to FIG. 1 of the drawings, a disperser 28 is attached to the side of a building 20 on the vertical facia board 22 directly beneath overhanging roof edge 26. The disperser is positioned on the vertical facia board 22, tangentially with roof edge 26 in the direct path of rainwater falling therefrom and as shown, spaced substantially above ground level. Disperser 28 includes mounting means 30 having a vertical base 32 positioned against facia board 22 and secured thereto by screws 34 or other type fasteners, as best depicted in FIGS. 3, 4, 5 and 6. Mounting means 30, as illustrated in FIGS. 2 - 5 is comprised of a single vertical base 32 extending the length of the disperser 28 or is a plurality of spaced vertical mounting bases (only one is illustrated). Disperser 28 also includes an outwardly sloping rainwater receiving surface 44, with a plurality of upward raised intermediate baffles 46 and a final dispersion baffle 47, all elongated in dimension parallel to the building 20. Disperser 28 is positioned with the elongated dimension of receiving surface 44, horizontally aligned with roof edge 26. Receiving surface 44 extends widthwise downward and outward, away from facia board 22 a distance thereby intercepting the path of rainwater run-off falling from roof edge 26. Rainwater receiving surface 44 is supported from vertical base 32, or by mounting bracket 52 as illustrated in FIG. 6. Receiving surface 44 is angled downwardly away from building 20, at roof edge 26. Extending across the length of receiving surface 44, and parallel to roof edge 26, are a plurality of uniformly spaced, generally parallel, upwardly extending baffles 46 and final breaker baffle 47, as best depicted in FIGS. 3 - 7. Intermediate baffle 46 is interrupted at uniformly spaced locations by accumulation pockets 48 which are formed by either semi-circular or "V" shaped baffle protrusion 49, which incline away from the elongated axis of baffle 46. Baffle protrusions 49 are staggered from one intermediate baffle 46 to the next baffle on the vertical plane, thereby to enable rainwater run-off to uniformly disperse across the length of receiving surface 44. Final breaker baffle 47, as shown in FIGS. 3 - 7 is a flanged barrier extending both upward, from receiving surface 44, and in the direction of elongation for disperser 28 at its outside edge, but parallel to building 22. Extending widthwise from final breaker baffle 47 upward and inward toward the last intermediate baffle 46 at side edge 51 of disperser 28 is end stop 50 for containment, accumulation and disposal of rainwater run-off at said final breaker 47. In FIG. 5 is an alternative embodiment in which all even numbered baffles 46 (only one is illustrated) from roof edge 26, are comprised of accumulation pockets 48 in which baffle protrusions 49 are inclined upward and inwardly toward roof edge 26. In FIG. 6 is illustrated an alternative mounting means 30, comprising a bracket 52, having a vertical base memeber 53, for connection to a facia board, an integral support arm 54 extending outwardly from base 53. Support arm 54 contains an upper support edge 55, set at a slight angle downwardly from the horizontal, in an outward direction from the base 53, and includes a pair of spaced edges 60, 61, at right angles to upper support edge 55. Downward extending spaced flanges 56, 57, on elongated outer and inner edges of the supporting surface 65 of disperser 28, frictionally engage edges 60, 61 of support arm 54 to retain receiving surface 44 in place. Supplemental fasteners, not shown, may additionally be employed to retain receiving surface 44 to support arms 54, if desired.

Figure 7:
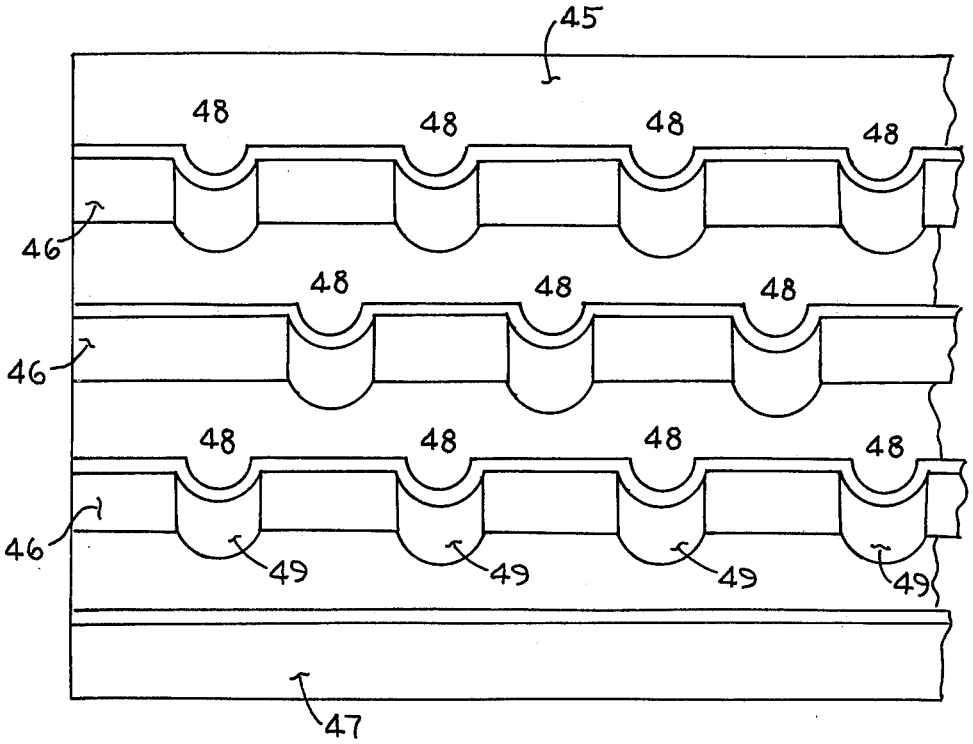
FIG. 7 is a frontal elevation view of an alternate embodiment of the dispersion structure.
Figure 8:
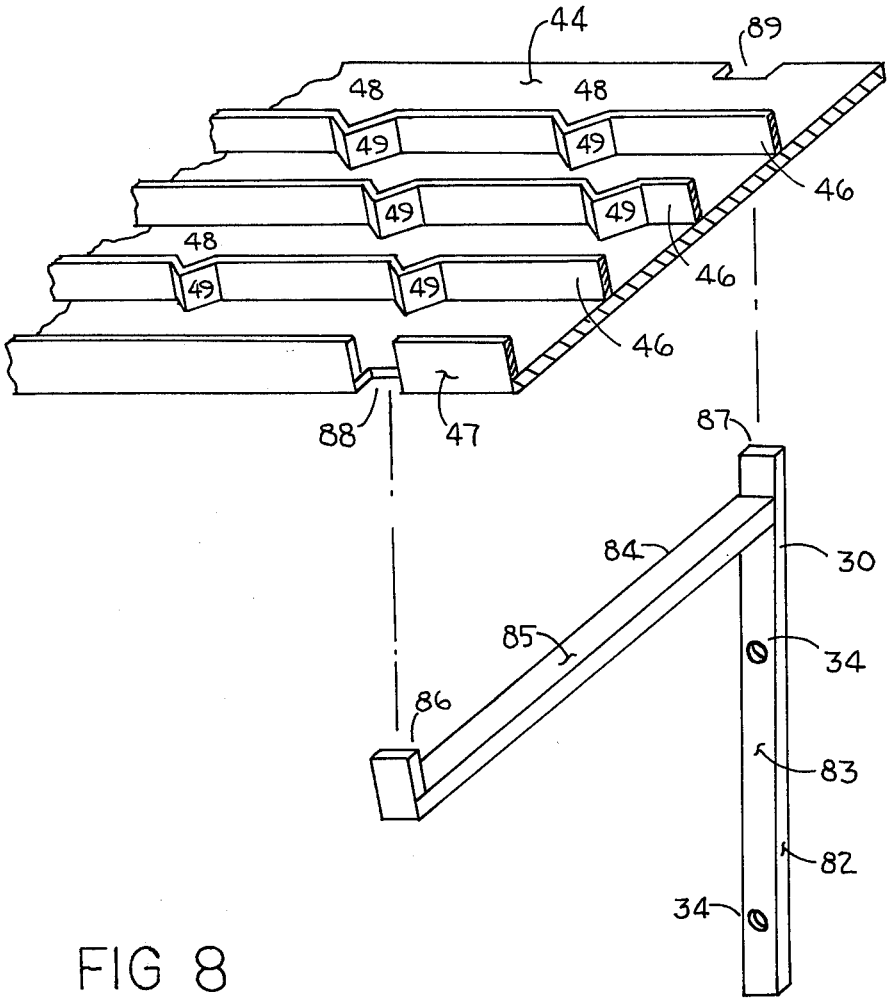
FIG. 8 is a fragmentary, isometric, exploded view of an alternate embodiment of the dispersion structure.

In FIG. 7 an alternate embodiment is illustrated, comprising intermediate baffles 46 in which accumulation pocket 48 is formed by a semi-circular shape protrusion 49 extending downward and outwardly away from roof edge 26. In FIG. 8, yet another alternate mounting means 30 is shown, comprising a bracket 82, having a vertical base member 83, for connection to a facia board 22, an integral support arm 84 extending downward and outward from vertical base 83. Support arm 84 comprises an upper support edge 85, set at a slight angle downward from the horizontal, and includes a pair of spaced flanges 86, 87 extending upward from upper support edge 25. Recessed notches 88 at the final breaker baffle 47 and notch 89 in receiving surface 44 of disperser 28 at the lead edge, adjacent to roof edge 26, frictionally engage flanges 86, 87 of support arm 85 to retain receiving surface 44 in place. In use, mounting means 30 is secured to facia board 22 to position receiving surface member 44 at roof edge 26 or immediately below any shingles overhanging the roof edge. Rainwater run-off from roof 24 falls freely onto receiving surface 44 of disperser 28 until the flow is impeded when first intermediate baffle 46 is encountered where rainwater flow is dispersed and channeled into accumulation pocket 48. As additional rainwater flow is diverted into accumulation pocket 48 the water level increases until it reaches the top surface of baffle protrusion 49 and overflows, onto the receiving surface 44 between the first two intermediate baffles 46. The above rainwater accumulation and overflow process is repeated at the second and subsequent intermediate baffles 46 and until the rainwater flow encounters final breaker baffle 47. At final breaker baffle 47, the rainwater flow is contained by end stops 50, accumulates until the water level overflows the top surface of the final breaker baffle 47 which causes a random dispersal of rainwater into fine droplets as it falls to ground level. The initial stream of rainwater from roof 24, is separated and channeled by such means, away from the building 26, to fall to ground level, over an extended area, in a random shower of dispersed droplets. Without employing gutters with their numerous disadvantages, the deterious effect of rainwater falling directly to the ground from roof edge 26 is avoided. Other embodiments of this invention will occur to those skilled in the art which are within the scope of the following claims.

What we claim is:

1. A rainwater run-off dispersion system and method for disposing of rainwater run-off from a sloped or pitched roof of a building, by converting said rainwater into a non-errosive shower of droplets and distributing over an extended area of the ground, by means of a structure mounted at the roof edge, which comprises:

a receiving surface, solid and impervious, elongated and of sufficient width to intercept the path of rainwater run-off flowing therefrom, a plurality of raised, intermediate baffles, which project upwards from said receiving surface, and extend continuously in the direction of elongation, to impede the flow of said rainwater run-off, a final breaker baffle which projects upward from said receiving surface, and extends continuously in the direction of elongation, at the edge of said receiving surface furthest from, but in a plane parallel to said roof edge, and from which, said rainwater run-off overflow falls in showers of droplets to the ground, a mounting means to secure said structure to the facia board of said building, so that said receiving surface is tangentially aligned and firmly positioned against roof edge.

2. The rainwater run-off dispersion system, claimed in claim 1, in which said plurality of intermediate baffles are uniformly distributed across the width of said structure, project upward from said receiving surface, and are contoured in cross-section to intercept, collect, contain and control said flowing rainwater run-off to said final breaker baffle, from which the overflow volume is dispersed outward and away from said building in a shower of droplets.

3. The rainwater run-off dispersion system claimed in claim 2 in which said intermediate baffles have extending from the elongated axis a plurality of uniformly spaced, semi-circular or "V" shaped baffle protrusions or pockets extending upward away from said receiving surface and inclined outward, away from said building.

4. The rainwater run-off dispersion system in claim 3 in which said baffle protrusions are staggered uniformly from one intermediate baffle to the next intermediate baffle.

5. The rainwater run-off dispersion system in claim 3 in which the direction of incline for all said baffle protrusions on all even numbered intermediate baffles, incline toward the roof edge and said baffle protrusions on all odd numbered intermediate baffles incline toward said final breaker baffle.

* * * * *